US008605928B2

(12) United States Patent
Linkenkær-Hansen et al.

(10) Patent No.: US 8,605,928 B2
(45) Date of Patent: Dec. 10, 2013

(54) HOOK FOR A HEARING AID

(75) Inventors: Morten Linkenkær-Hansen, Varlose (DK); Jorgen Mejner Olsen, Hillerod (DK)

(73) Assignee: Widex A/S, Lynge (DK)

( * ) Notice: Subject to any disclaimer, the term of this patent is extended or adjusted under 35 U.S.C. 154(b) by 1468 days.

(21) Appl. No.: 11/928,304

(22) Filed: Oct. 30, 2007

(65) Prior Publication Data

US 2008/0085024 A1 Apr. 10, 2008

Related U.S. Application Data

(63) Continuation-in-part of application No. PCT/DK2005/000344, filed on May 25, 2005.

(51) Int. Cl.
*H04R 25/00* (2006.01)

(52) U.S. Cl.
USPC ..... 381/330; 381/322; 381/324; 181/129

(58) Field of Classification Search
USPC ..... 381/322, 324, 330; 181/129, 130
See application file for complete search history.

(56) References Cited

U.S. PATENT DOCUMENTS

| | | | | |
|---|---|---|---|---|
| 2,975,244 | A | 3/1958 | Lehr | |
| 2,882,348 | A * | 4/1959 | Erickson | 381/330 |
| 3,080,011 | A * | 3/1963 | Henderson | 181/135 |
| 3,457,375 | A * | 7/1969 | Haggerty | 381/322 |
| 3,491,214 | A * | 1/1970 | Rosemond et al. | 381/330 |
| 4,727,582 | A | 2/1988 | De Vries et al. | |
| 5,046,580 | A * | 9/1991 | Barton | 181/135 |
| 6,735,319 | B1 * | 5/2004 | Vonlanthen | 381/330 |
| 2004/0141628 | A1 | 7/2004 | Villaverde | |

FOREIGN PATENT DOCUMENTS

| | | | | |
|---|---|---|---|---|
| DE | 298 19 415 U1 | | 3/1999 | |
| WO | WO2004/008803 | * | 1/2004 | H04R 25/00 |

OTHER PUBLICATIONS

Japanese Office Action JP2008-512686 dated Jan. 18, 2011 with English Translation.

* cited by examiner

*Primary Examiner* — Jesse Elbin
(74) *Attorney, Agent, or Firm* — Sughrue Mion, PLLC

(57) ABSTRACT

A hook (4) for a hearing aid (1) provides a sound passage for transmitting the sound emanating from an output transducer of the hearing aid. The hook is composed of different parts (4*a*, 4*b*, 4*c*) made from materials with different mechanical properties. This provides a damping means for damping mechanical vibrations. The invention further provides a hearing aid with a hook.

10 Claims, 4 Drawing Sheets

HOOK FOR A HEARING AID

RELATED APPLICATIONS

The present application is a continuation-in-part of application No. PCT DK2005/000344, filed on 25 May 2005, in Denmark and published as WO 2006/125434 A1.

BACKGROUND OF THE INVENTION

1. Field of the Invention

The present invention relates to hearing aids. The invention, more specifically relates to a hook for a hearing aid, in particular a BTE-type hearing aid, and a hearing aid utilizing a hook.

2. The Prior Art

BTE-type hearing aids generally have a hearing aid housing comprising a shell in which all of the electronics, including input and output transducers, of the hearing aid are typically located. The shell is worn Behind The Ear, hence the abbreviation BTE. If the output transducer is located in the hearing aid housing, the output sound from the hearing aid is conducted via a sound tube to an earplug placed in an ear of the person wearing the hearing aid.

BTE-hearing aids generally have a hook-shaped part forming the transition from the hearing aid housing in which the sound output transducer is located to the sound tube. This hook-shaped part may be integrally formed with the shell of the hearing aid housing. The hook-shaped part has a curved shape, which may inter alia serve to hold the hearing aid in a correct position behind the ear of the wearer.

Often, however, in BTE-hearing aids the sound tube is not connected directly to the shell of the hearing aid housing. Rather, a separate intermediate piece, commonly referred to as a hook, forms the transition between the shell of the hearing aid housing and the sound tube.

The hook is made from a material which is more rigid than that of the sound tube in order to allow the sound tube to be readily attached thereto and removed therefrom. As the name hook indicates, it has a curved shape. The external shape of the hook is usually so that a smooth transition from the hook to the hearing aid housing, to which it is attached, is obtained. Thus, at the proximal end, where the hook is attached to the hearing aid housing, the external cross-section usually matches that of the hearing aid housing. The hook generally has a taper from the proximal end towards the distal end. Internally the hook has a sound passage extending from the proximal end to the distal end. This passage usually has a circular cross-section, with a constant diameter along the length.

In hearing aids it is well known that feed-back problems exist between the output transducer, and the input transducer. The feed-back is inter alia a problem because it limits the maximum gain achievable with the hearing aid.

The present invention bases itself on the realisation by the inventors that even though the output transducer and input transducer are located in the same housing, the hook attached to the shell of the hearing aid housing, or if the hearing aid has an integral housing, the hook-shaped part extending beyond the output transducer plays a role in these feedback problems.

On this background the present invention sets out to reduce the amount of feed-back between output and input transducers in hearing aids, in particular of the BTE-type. In this respect it should be noted that wherever the present description and claims makes reference to an input transducer, the use of more than one input transducer is not excluded. The skilled person will know that more than one input transducer is commonly used, e.g. in order to obtain directionality, and that the number of input transducers is generally immaterial to the feed-back problems as discussed herein.

SUMMARY OF THE INVENTION

According to a first aspect of the invention, this object is achieved by a hook for a hearing aid, said hook being adapted for providing a sound passage for transmitting the sound emanating from an output transducer in a housing of the hearing aid, said hook comprising a first part made of a first material and a second part made of a second material, wherein said first and second materials have different elastic properties. By using two different materials, it is achieved that mechanical vibrations, in particular in the audible frequency range, are not transmitted from the hook to the input transducers in the hearing aid housing.

According to a second aspect of the invention, this object is achieved by a hearing aid comprising a hook-shaped sound output part having a sound passage for transmitting the sound emanating from an output transducer of the hearing aid, wherein said hearing aid comprises damping means for damping mechanical vibrations of the hook-shaped sound output part.

By the provision of such a damping means in connection with the hearing aid, it is achieved that mechanical vibrations, in particular in the audible frequency range, are not transmitted from the hook-shaped sound output part to the input transducers in the hearing aid housing.

In a preferred embodiment of the first aspect of the invention, said first and second materials are provided as integral parts of the hook. Providing both materials as integral parts of the hook, rather than e.g. one of them as a separate part to be mounted thereon or as a part of a hook assembly, is preferable in terms of manufacturing and storing.

Presently it is preferred to provide said one of the materials as a section between a proximal end of said hook and a distal end of said hook. This allows simple manufacturing, e.g. by adhering parts of the hook together.

In a further preferred embodiment according to the first aspect of the invention, said first material is a layer of adhesive material joining two parts of the hook. In this case the adhesive serves as a vibration damping material. Thus, no further parts of vibration damping material will be necessary.

In yet a further embodiment according to the first aspect of the invention, said first material is a rubber material. This is preferred, as it allows many design options, e.g. using the rubber itself as adhesive between two parts of a hook made of a plastic material. Using a plastic material is preferable, because it allows the hook to have virtually the same properties as existing hooks. Hooks, which are interchangeable with existing hooks of existing hearing aids may thus be made, thus allowing improvement of existing hearing aids.

In a most preferred embodiment according to the first aspect of the invention, of said first and second materials, the material of which the minor part of the hook is made is provided as a material, which is softer than the material of which the major part of the hook is made. This allows the use of both the rubber and plastic materials referred to above.

In a first embodiment of the hearing aid according to the second aspect of the invention the damping means is provided as an integral part of the hook. Providing the damping material as an integral part of the hook, rather than e.g. a separate part to be mounted thereon, as a part of a hook assembly, is preferable in terms of manufacturing and storing.

Alternatively, however, the damping means may be provided as a separate part between the hook and the part of the hearing aid housing containing the output transducer. Thus rather than substituting the existing conventional hook of a used hearing aid with a hook with integral damping means according to the invention, a damping means could instead be inserted between the existing hook and the housing of a hearing aid, without departing from the invention.

According to a further embodiment of the hearing aid according to the second aspect of the invention, however, the damping means is provided between the part of the hearing aid housing in which the output transducer is located and the hook-shaped part. This allows the damping means to be provided as a separate piece, insertable between the hook and the hearing aid housing.

According to yet a further embodiment of the hearing aid according to the second aspect of the invention, the damping means is provided as a damping material, which is softer than the material of which the major part of the hook-shaped part and the hearing aid housing are made. This allows the use of both the rubber and plastic materials referred to above.

BRIEF DESCRIPTION OF THE DRAWINGS

The invention will now be described in greater detail based on non-limiting exemplary embodiments, illustrated in the drawings. On the drawings

DETAILED DESCRIPTION OF THE INVENTION

Figure 1A:
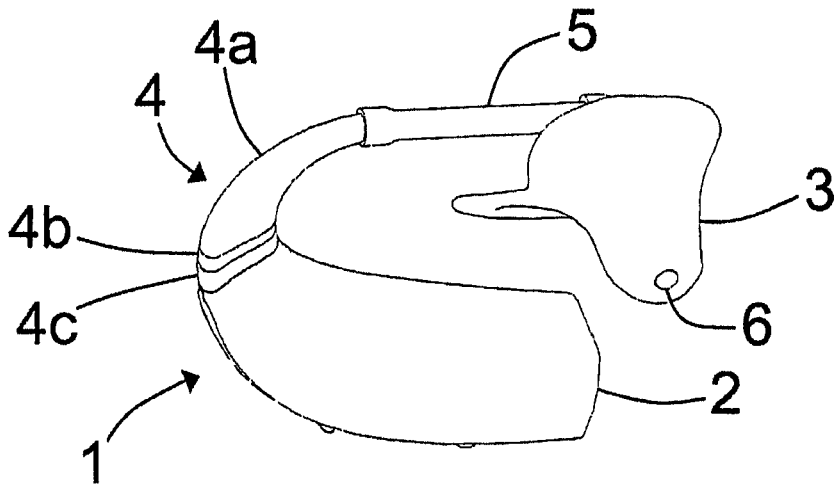
FIG. 1*a* shows a perspective view of a BTE hearing aid incorporating a hook according to the invention.
Figure 1B:
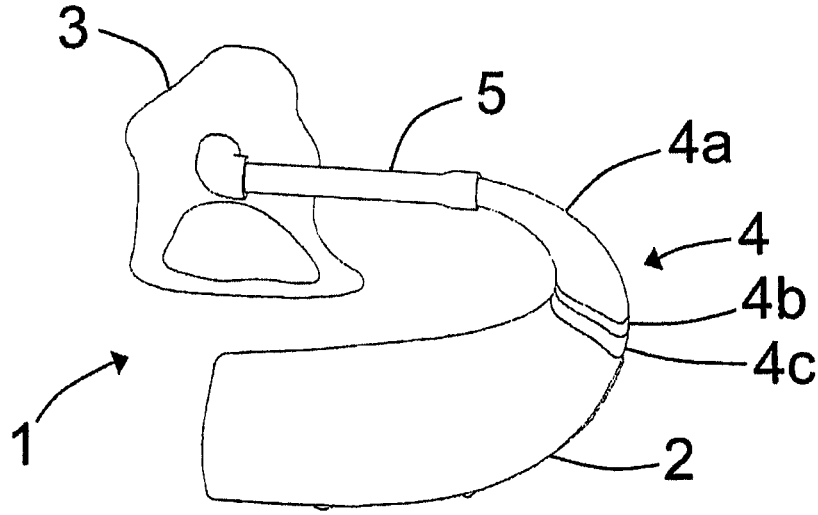
FIG. 1*b* shows a different perspective view of the BTE hearing aid of FIG. 1*a;*

FIGS. 1*a* and 1*b* show a hearing aid 1 from different angles. The hearing aid 1 comprises four parts, namely a hearing aid housing 2, an earplug 3, a hook 4 and a sound tube 5. The hearing aid housing 2 may comprise all of the electronics of the hearing aid, including input and output transducers, signal processing means, switches, battery, etc.

To the hearing aid housing 2 the hook 4 is attached. The attachment of the hook 4 to the hearing aid housing 2 can be of a more or less permanent nature. That is to say, it may be detachable without the use of tools, or it may be in a mechanical engagement with the housing, necessitating the housing parts to be disassembled by means of tools in order to replace or remove the hook. To the other end of the hook 4 one end of a sound tube 5 is attached. The other end of the sound tube 5 is attached to an earplug 3.

The sound tube 5, and in particular the earplug, are prone to be soiled from their use, and thus need to be replaceable. Consequently, the sound tube 5 is readily detachable from the hook 4, as well as from the earplug 3, without the use of any tools.

The hook 4, the sound tube 5 and the earplug 3 all include a sound passage so as to form a continuous sound passage for conducting sound from the transducer in the hearing aid housing to an output opening 6 in the earplug 3. Depending on the actual location of the output transducer in the hearing aid housing 2, the hearing aid housing 2 may also include an internally arranged tubular member forming part of the sound passage from the output transducer to the sound output opening 6 of the earplug 3.

Figure 2:
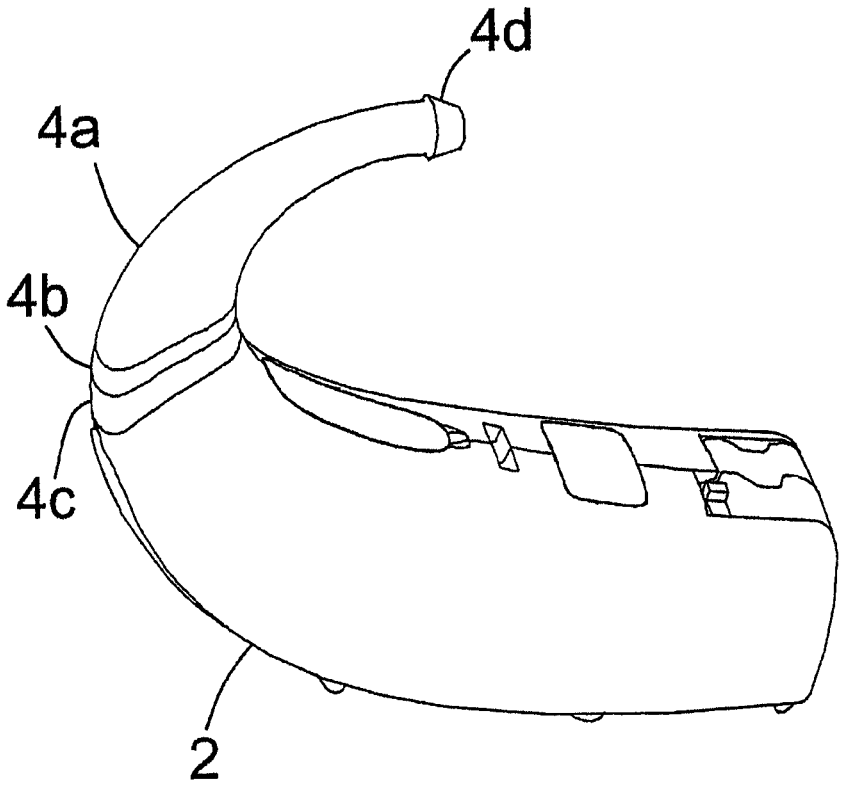
FIG. 2 shows a hearing aid housing of the hearing aid including the attached hook according to the invention.

FIG. 2 shows the hook 4 and the hearing aid housing 2 in greater detail. As can be seen, the hook of the embodiment illustrated comprises three parts 4*a*, 4*b*, 4*c*. The three parts 4*a*, 4*b*, 4*c* are shown in greater detail in the exploded views of FIG. 3*a* and FIG. 3*b*.

The parts 4*a* and 4*c* are both made of a plastic material, preferably but not necessarily the same plastic material. The distal end of the hook 4, i.e. the end of the part 4*a* is provided with a sound tube engaging and holding means 4*d*. In the illustrated example the sound tube engaging and holding means is provided as a circumferential barb 4*d*. As can best be seen from FIG. 3*b*, the proximal end of the hook 4, i.e. the end of the part 4*c* is provided with a housing engagement means. In the illustrated example the housing engagement means made by undercutting the end of the part 4*c* to form a groove 4*e*, in which the shell parts of the hearing aid housing 2 engage, so as to secure the hook 4 to the hearing aid housing 2.

Between the part 4*a* and the part 4*c* the third part 4*b* is located. The third part 4*b* comprises a vibration damping material. The inclusion of such a vibration damping material in the hook 4 has been found to substantially reduce the feedback from the hook 4 to the input transducer. The vibration damping material is preferably a softer material than the material of which the parts 4*a* and 4*c* are made.

Preferably, the parts 4*a* and 4*c* are made of a transparent plastic material such as PMMA (Polymethyl Methacrylate), PC (Polycarbonate), CP (Cellulose Plastic), PEX (Cross-linked Polyethylene) or the like or of an opaque plastic material such as ABS (Acrylonitrile Butadiene Styrene) or POM (Polyoxymethylene) or the like. Alternatively they could be made of metal such as aluminium or stainless steel. The softer vibration damping material of the third part 4*b* is preferably a rubber material such as silicone, butyl, EDPM (Ethylene Propylene Diene Monomer), TPE (Thermoplastic Elastomer) or the like. Other damping materials than rubber may of course also be used.

It should be understood that the damping material can be integrated in the hook 4 in many different ways.

Figure 3A:
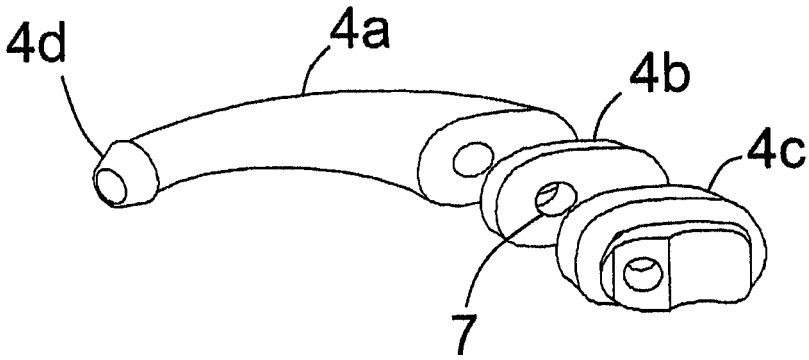
FIG. 3*a* shows an exploded view of the hook according to the invention, seen from a first angle.
Figure 3B:
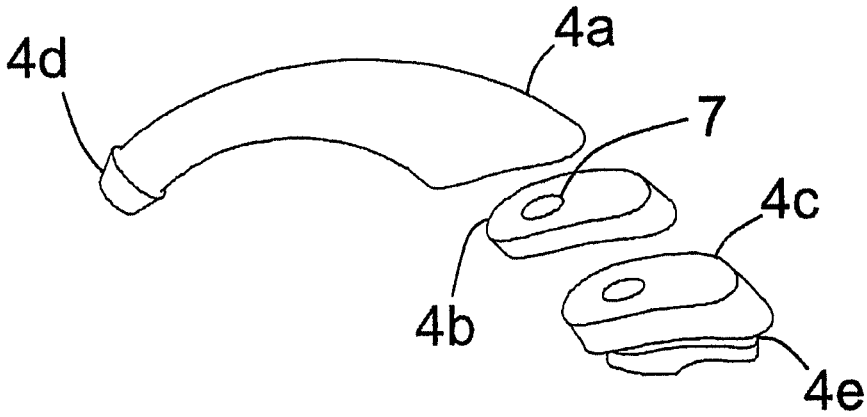
FIG. 3*b* shows an exploded view of the hook according to the invention, seen from another angle.

In the exploded views of FIG. 3*a* and FIG. 3*b* the vibration damping material is provided as a section between the proximal end of the hook 4 and the distal end of said hook 4. The section can be made as a separate part 4*b*, to which the respective faces of the parts 4*a* and 4*c* are subsequently adhered. The part 4*b* of vibration damping material has a generally annular shape, as it, like the rest of the hook 4, includes a sound passage 7. The separate part 4*b* and the other parts 4*a*, 4*c* of the hook 4, can be formed in separate moulding processes. Alternatively, the hook 4 could be integrally formed in a multi-component moulding process, such as a two-component injection moulding process. Also, if the damping material is provided as a separate part, it could be formed with mechanical locking means for engaging corresponding locking means formed on the respective parts 4*a*, 4*c*.

However, experiments have shown that even a thin segment of vibration damping material between the parts 4*a* and 4*c* significantly reduces the feedback. Thus, by appropriate choice of adhesive, such as silicone glue, the vibration damping material can be provided by the adhesive joining the two parts 4*a* and 4*c* of the hook 4 to each other, without the use of a separate vibration damping member as such. That is to say, the adhesive itself serves at the vibration damping means.

It is presently preferred that the vibration damping material is located closer to the proximal end of the hook 4, than to the distal end. Preferably less than half the distance from the proximal end to the distal end, and in particular less than a third of the distance from the proximal end to the distal end.

Also, it should be noted that the embodiment illustrated is only a currently preferred embodiment, and that the vibration damping material needs not be located between the two end parts 4*a*, 4*c* of the hook 4. Rather, the hook 4 can comprise two parts only, i.e. a rigid part and a soft part. Preferably, the soft part is located at the proximal end of the hook 4 adjacent the hearing aid housing 2. In particular, the hook could be formed as a single part and the vibration damping material could be located as a spacer between the hook 4 and the hearing aid housing 2.

The thickness of the vibration damping means may depend on the materials or the manufacturing process used. Presently, a thickness of 1 to 3 mm is preferred for a separate element of damping material. However, smaller thicknesses may also be used. In particular if, as indicated above, an adhesive is used as the sole damping material, the thickness thereof may be less than 1 mm, e.g. between 1 mm and 0.1 mm, preferably approximately 0.3 mm.

Moreover, it should be noted that the invention is not limited to the use of a single segment of damping material. Rather, several segments of damping material can be used, possibly with different elastic properties.

Also, it should be noted that even though the illustrated embodiment presents an annular section of damping material with a constant thickness, the annular section needs not have a constant thickness. For instance, the annular segment could be tapered towards the concave side of the hook.

Although the above description of the currently most preferred embodiment relates to the use of the damping means in connection with a separate, replaceable hook, the invention is not restricted to this.

Figure 4A:
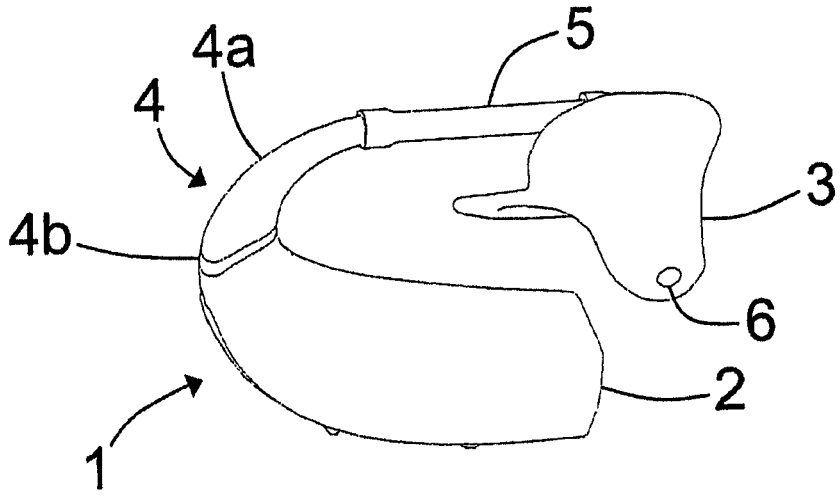
FIG. 4*a* shows a perspective view of a BTE hearing aid incorporating a damping means according to the invention.
Figure 4B:
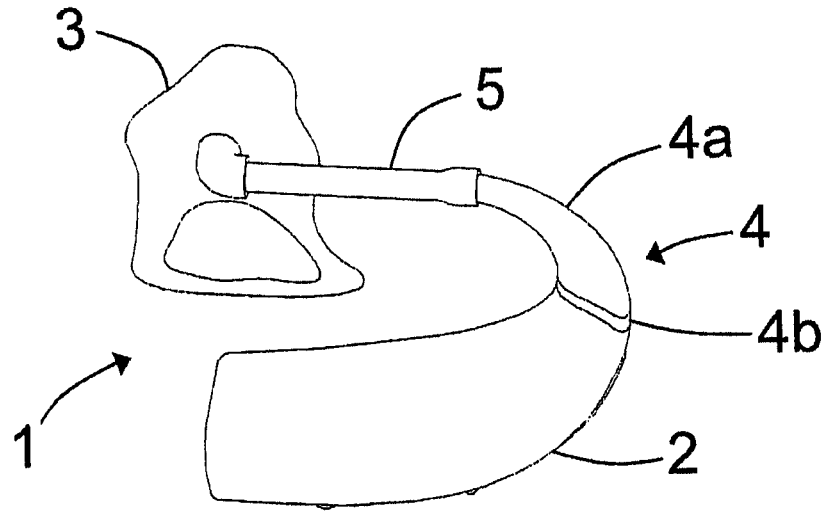
FIG. 4*b* shows a different perspective view of the BTE hearing aid of FIG. 4*a*.

Rather, in a second embodiment of FIGS. 4*a* and 4*b* the damping means is included as an element 4*b* located between the remainder of the hook 4*a* and the part of the hearing aid housing 2 containing the output transducer. The damping means 4*b* could be a layer of adhesive joining the hook 4 to the remainder of the hearing aid housing 1. Alternatively the remainder of the hook 4*a*, the damping material 4*b* and at least a part of the housing 2 could be formed integrally, e.g. using a multi-component moulding process, e.g. a two component injection moulding process.

Also, the considerations in respect of materials, dimension, shapes referred to above in connection with the separate hook 4 of the first embodiment would be valid for this second embodiment.

Implicitly, the invention can also be said to utilize a method for reducing feedback in a hearing aid 1, in which the sound is emitted from an output transducer in the hearing aid housing 2 to a hook 4 attached thereto, where the method includes the step of damping vibrations by use of a damping means in connection with the hook 4.

We claim:

1. A hook for a hearing aid, said hook being adapted for forming a transition between a housing of said hearing aid and a sound tube, and for providing a sound passage for transmitting the sound emanating from an output transducer in said housing to said sound tube, said hook comprising a distal part and a vibration damping part, said distal part being made of a first material and said vibration damping part being made of a second material which comprises a layer of adhesive material joining said distal part with another part of said hearing aid, wherein said first and second materials have different elastic properties whereby said second material acoustically separates said distal part from said another part so that acoustic energy present in said distal part is absorbed by the adhesive material and not passed to the hearing aid housing.

2. The hook according to claim 1, wherein said distal part and said damping part are provided as integral parts of the hook.

3. The hook according to claim 1, wherein said distal part is provided as at least one section at an end of said hook distally of said housing.

4. The hook according to claim 1, comprising a proximal part.

5. The hook according to claim 4, wherein said distal part and said proximal part are made of a plastic material.

6. The hook according to claim 4, wherein said proximal part constitutes a minor part of the hook and is made of a material that is softer than said first material.

7. The hook according to claim 1, wherein said adhesive material is a rubber material.

8. A hearing aid comprising a hearing aid housing and a hook-shaped sound output part having a sound passage for transmitting the sound emanating from an output transducer in said hearing aid housing, wherein said output part comprises damping means in the form of a section of adhesive material joining a distal part of said output part with another part of said hearing aid, said adhesive material acoustically separating said distal part from said another part so that acoustic energy present in said distal part is absorbed by said adhesive material and is not passed to said hearing aid housing.

9. The hearing aid according to claim 8, wherein said damping means is provided as an integral part of the hook.

10. The hearing aid according to claim 8, wherein said damping means is provided as a damping material, which is softer than the materials of which said distal part of said output part and said hearing aid housing are made.

* * * * *